US010835062B1

(12) United States Patent
Calton

(10) Patent No.: US 10,835,062 B1
(45) Date of Patent: Nov. 17, 2020

(54) WHOLE ARM AND HAND PILLOW

(71) Applicant: Christopher Lamonte Calton, Justin, TX (US)

(72) Inventor: Christopher Lamonte Calton, Justin, TX (US)

( * ) Notice: Subject to any disclaimer, the term of this patent is extended or adjusted under 35 U.S.C. 154(b) by 219 days.

(21) Appl. No.: 16/020,974

(22) Filed: Jun. 27, 2018

(51) Int. Cl.
*A47G 9/10* (2006.01)
*A47C 20/02* (2006.01)

(52) U.S. Cl.
CPC ..... *A47G 9/1063* (2013.01); *A47C 20/023* (2013.01); *A47G 9/1027* (2013.01); *A47G 9/1054* (2013.01)

(58) Field of Classification Search
CPC ..... A47G 9/1027; A47G 9/10; A47G 9/1054; A47G 9/1063; A47C 20/023; A41D 13/08
See application file for complete search history.

(56) References Cited

U.S. PATENT DOCUMENTS 3,883,906 A * 5/1975 Sumpter ..... A47G 9/1063 5/632
6,041,458 A * 3/2000 Vickers ..... A47G 9/10 5/490
7,962,984 B2 * 6/2011 Popp ..... A47D 13/083 5/490
9,226,605 B1 * 1/2016 Castellano ..... A47G 9/1063
D800,420 S * 10/2017 Rivera ..... D2/731
2006/0179574 A1 * 8/2006 Margalit ..... A47D 13/02 5/655
2007/0204373 A1 * 9/2007 Loyens ..... A41D 31/245 2/16
2013/0000042 A1 * 1/2013 Ferrell ..... A47G 9/10 5/636

* cited by examiner

*Primary Examiner* — Eric J Kurilla
*Assistant Examiner* — Amanda L Bailey

(57) ABSTRACT

A pillow sleeve that cover a user's entire arm from the palm of their hand to their deltoid. The pillow sleeve is formed from layers of material and padding to provide a pillow like surface for sleeper to rest their head on their arms.

1 Claim, 5 Drawing Sheets

WHOLE ARM AND HAND PILLOW

BACKGROUND

1. Field of the Invention

The present invention relates generally a system and method of supporting a user resting on their arm, and more specifically to a system and method for wrapping a user's arm in a pillow for sleeping on an arm.

2. Description of Related Art

Conventional devices for supporting a head on an arm typically consist of a band of cushion located on a specific portion of an arm. Conventional devices require the user to place their head in a specific place to receive a cushion. As the user moves during their rest the user's head can fall off the small cushion and wake the user up. While there are many systems for head rests and pillows known in the art, considerable room for improvement remains.

DESCRIPTION OF THE DRAWINGS

The novel features believed a characteristic of the embodiments of the present application is set forth in the appended claims. However, the embodiments themselves, as well as a preferred mode of use, and further objectives and advantages thereof will best be understood by reference to the following detailed description when read in conjunction with the accompanying drawings, wherein:

Figure 1:
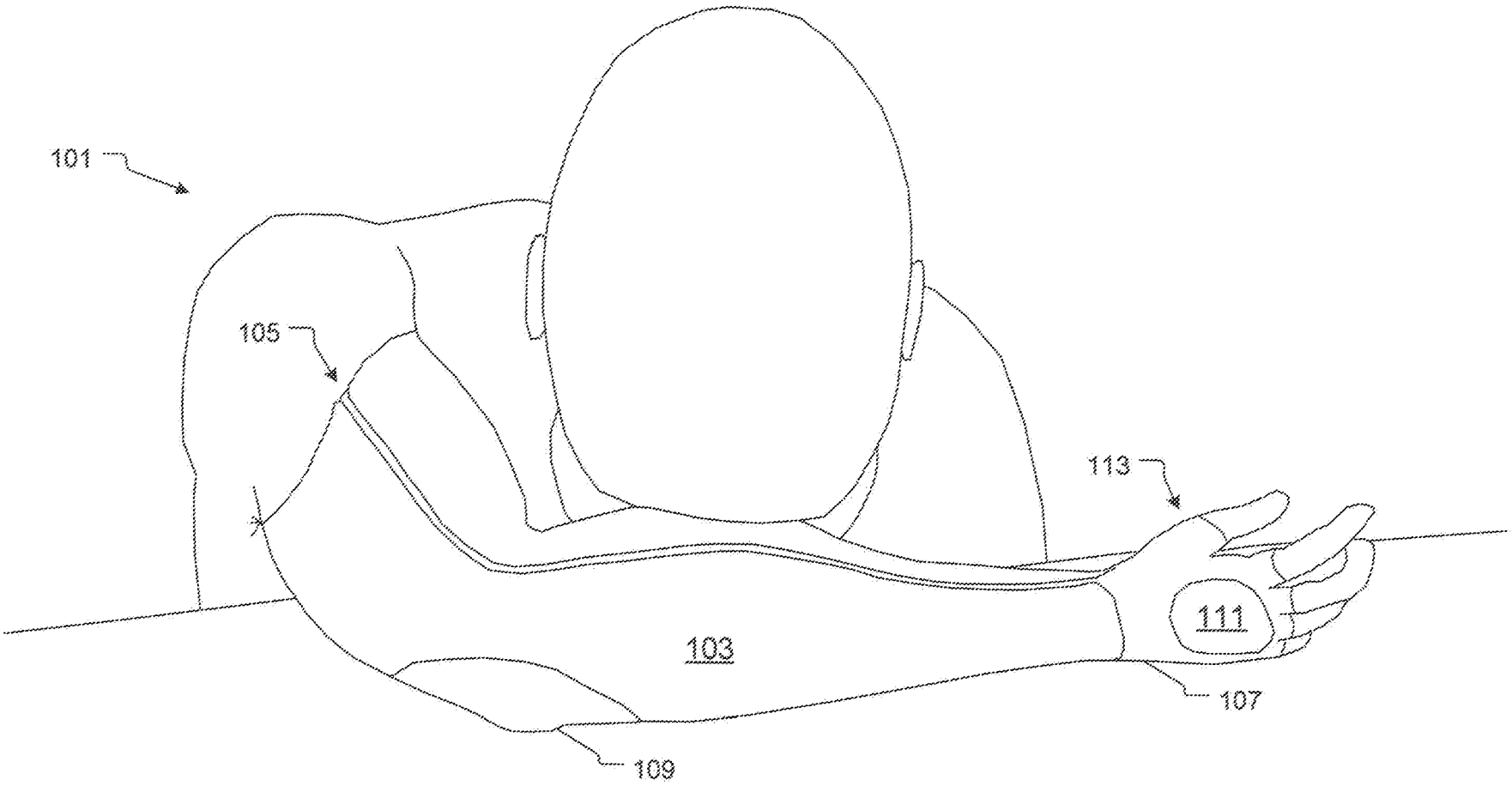
FIG. 1 is a perspective view of a whole arm and hand pillow illustrated according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the apparatus for a whole arm and hand pillow are provided below. It will, of course, be appreciated that in the development of any actual embodiment, numerous implementation-specific decisions will be made to achieve the developer's specific goals, such as compliance with assembly-related and business-related constraints along with different applications for various venues, which will vary from one implementation to another. Moreover, it will be appreciated that such a development effort might be complex and time-consuming, but would nevertheless be a routine undertaking for those of ordinary skill in the art having the benefit of this disclosure.

The present application comprises a novel pillow sleeve comprising a compression garment configured to be applied to a user's arm and hand to promote good circulation while sleeping on one's arm or hand. The sleeve will include padded members for sleep or nap in comfort. The device eliminates numbness while sleeping and provides a replacement for traditional pillows.

The arm and hand pillow sleeve is comprised of a microfiber sleeve with gel-infused comfort memory foam, with padded elbow and hand. This sleeve that would slide onto the user's hand and would extend to the deltoid (shoulder) excluding the fingers. It would detach with Velcro and neoprene from the wrist to the deltoid. The pillow casing would be plain or offered in various designs. It would be stitched onto the sleeve and should be flexible at the elbow with the stitched design around the elbow and hand. The pillow sleeve would help the user to sleep in comfort without the worry of lack of circulation in the arm and hand causing numbness and limited blood circulation. It would offer additional comfort and support while sleeping or napping. This product would be convenient, effective, and therapeutic. The arm and hand pillow sleeve could be produced in small, medium, large, and extra-large sizes.

The new features of arm and hand pillow sleeve are its novel and adjustable design, convenience, practicality, effectiveness, durability, light weight, compact size, portability, novelty, and eye-catching design. This sleeve would offer additional comfort and support while sleeping or napping. This product would easily attach to the arm and could be easily adjusted to suit any individual's needs. The arm and hand pillow sleeve would offer support for the head and neck while sleeping or napping. It would prevent the arm or hand from becoming numb due to lack of circulation. This sleeve could contribute to overall better health and a better night's sleep. This product would serve as a viable alternative to traditional pillows. It would be therapeutic for all ages and could be particularly beneficial to individuals napping in their home or middle and high school, and college students who may rest their heads after an exam. These and other individuals would have peace of mind knowing that head and neck support would be efficiently provided while wearing the arm and hand pillow sleeve. It could also benefit individuals in the military, and its lightweight and compact size could be easily stored and transported while traveling. It will also have medical benefits, promoting productive flow of blood circulation and eliminating pain during and after numbness.

Referring now to FIG. 1 in the drawings, a perspective view of a whole arm and hand pillow illustrated according to the present application. System 101 is comprised of a pillow sleeve 103 that spans along an arm of a user from their palm to their deltoid or shoulder. Pillow sleeve 103 is comprised of a plurality of layers of materials along with a seam 105, the pillow sleeve wraps around entirely around the arm. Pillow sleeve 103 is further comprised of a glove portion 107, an elbow pad 109, an upper wrist pad 111 located on a top portion of the glove portion 107, and a palm wrist pad 113 located on a bottom portion of the glove portion 107.

Figure 2:
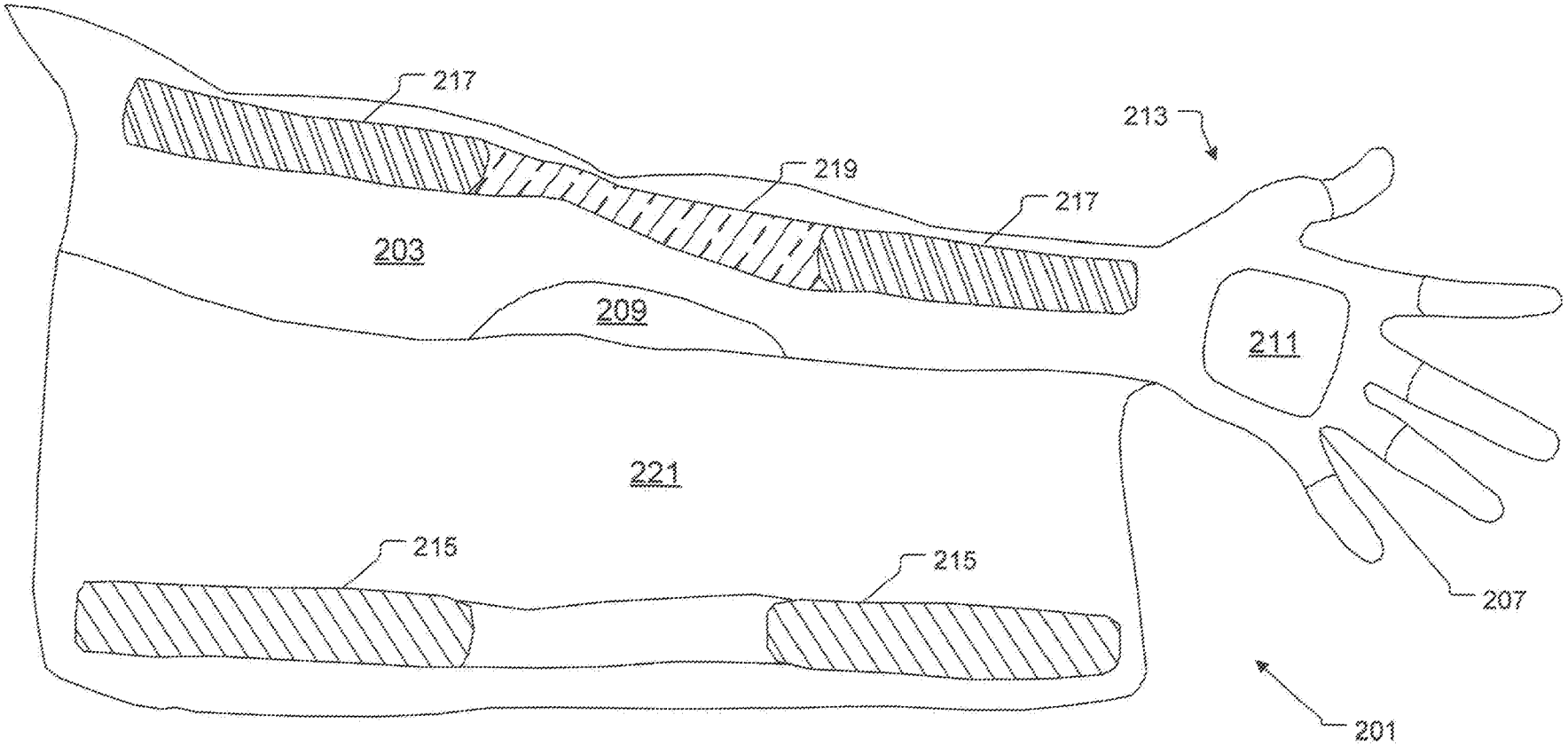
FIG. 2 is a perspective view of a whole arm and hand pillow unwrapped illustrated according to the present application.

Referring now also to FIG. 2 in the drawings, a perspective view of a whole arm and hand pillow partially unwrapped illustrated according to the present application. System 201 is comprised of a pillow sleeve 203 that spans along an arm of a user from their palm to their deltoid or shoulder and completely surrounds the user's arm. Pillow sleeve 203 is comprised of a plurality of layers of materials comprising a microfiber layer and a memory foam layer. When closed the pillow sleeve wraps around entirely around the arm. As shown the pillow sleeve is partially opened by disconnecting a flap 205 from the sleeve. Pillow sleeve 203 is further comprised of a glove portion 207, an elbow pad 209, an upper wrist pad 211 sewed on a top portion of the glove portion 207, and a palm wrist pad 213 located on a bottom portion of the glove portion 207.

Pillow sleeve 203 is further comprised of at least one region of hook tape 215, at least one region of neoprene 217, at least one region of gel-infused memory foam 219, and a flap 221. Flap 221 allows users to adjust a tightness of the sleeve as the flap is folded over and hooked to the sleeve by the hook tape 215. The sleeve is typically made of material having loops covering the exterior of the sleeve for the hook tape 215 to engage with and secure flap 221. Alternatively regions of loop tape are located on the sleeve 203 to secure the flap 221.

Figure 3:
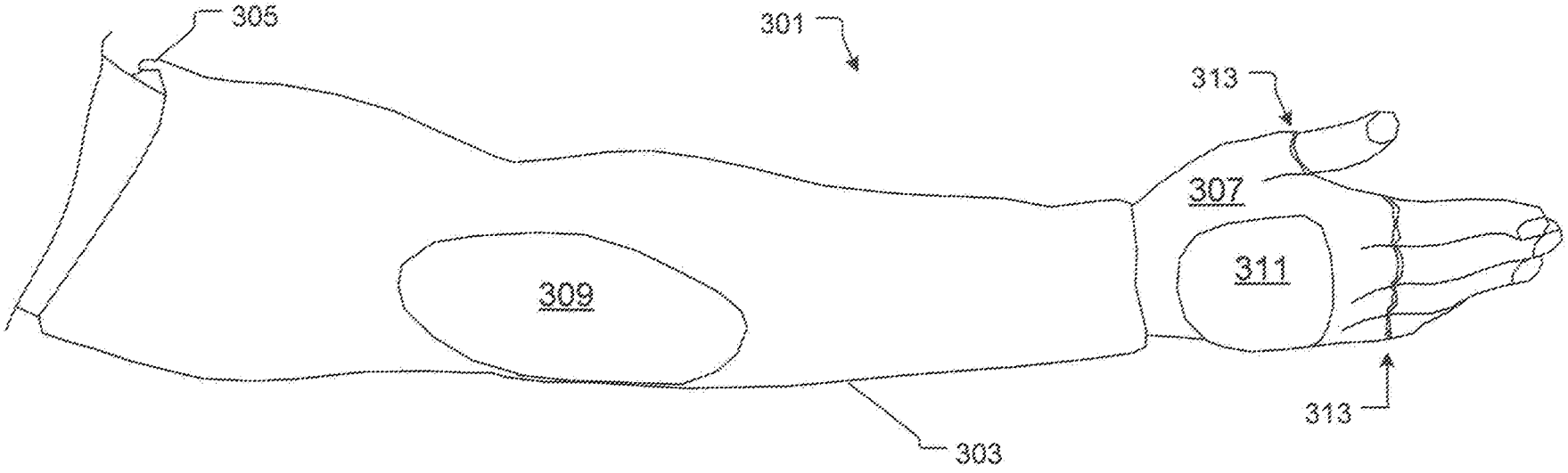
FIG. 3 is a perspective view of a whole arm and hand pillow illustrated according to the present application.

Referring now also to FIG. 3 in the drawings, a perspective view of a whole arm and hand pillow illustrated according to the present application. System 301 is comprised of a pillow sleeve 303 that spans along an arm of a user from their palm to their deltoid or shoulder. Pillow sleeve 303 is comprised of a plurality of layers of materials along with a flap 305, the pillow sleeve wraps around entirely around the arm. Pillow sleeve 303 is further comprised of a glove portion 307, an elbow pad 309 sewed into the flap 305, a wrist pad 311 sewed on a top portion of the glove portion 307. While the elbow pad 309 and the wrist pad 311 are typically sewed into place, alternatively the pads are glued or fused into place without the need for thread. Additionally, glove portion 307 comprises elastic material straps 313 located in the fingerless glove region to help retain the user's fingers.

Figure 4:
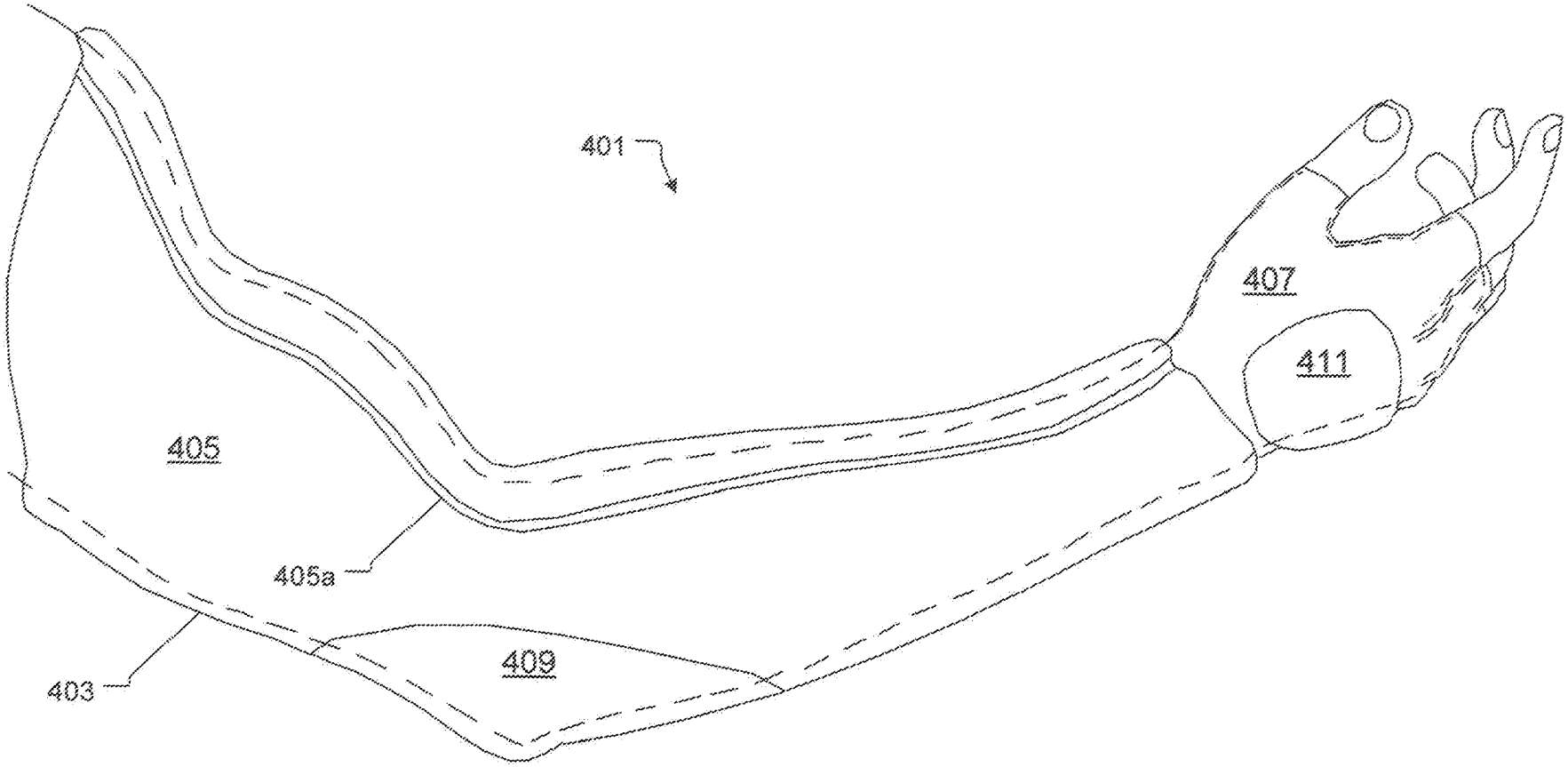
FIG. 4 is a perspective view of a whole arm and hand pillow illustrated according to the present application.

Referring now also to FIG. 4 in the drawings, a perspective view of a whole arm and hand pillow illustrated according to the present application. System 401 is comprised of a pillow sleeve 403 that spans along an arm of a user from their palm to their deltoid or shoulder. Pillow sleeve 403 is comprised of a plurality of layers of materials along with a flap 405 that forms a seam when closed as illustrated 405*a*, the pillow sleeve wraps around entirely around the arm. Pillow sleeve 403 is further comprised of a glove portion 407, an elbow pad 409 sewed into the flap 405, a wrist pad 411 sewed on a top portion of the glove portion 407. The dashed lines as shown illustrate an outline of the user's arm located inside the sleeve 403.

Figure 5:
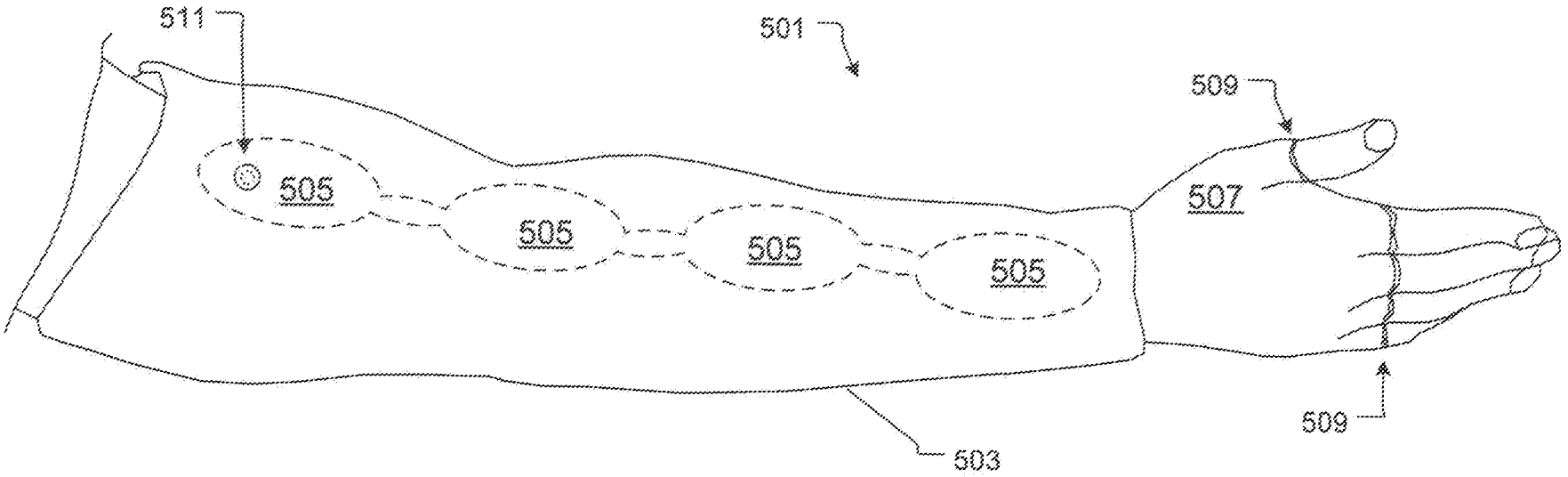
FIG. 5 is a perspective view of a whole arm and hand pillow illustrated according to the present application.

Referring now also to FIG. 5 in the drawings, a perspective view of a whole arm and hand pillow illustrated according to the present application. System 501 is comprised of a pillow sleeve 503 that spans along an arm of a user from their palm to their deltoid or shoulder. Pillow sleeve 503 is comprised of a plurality of layers of materials along with a plurality of inflatable regions 505, the pillow sleeve wraps around entirely around the arm. Pillow sleeve 503 is further comprised of a glove portion 507. Additionally, glove portion 507 comprises elastic material straps 509 located in the fingerless glove region to help retain the user's fingers.

Inflatable regions 505 are individual pockets of sealed gas inflated by the user to provide adjustable padding and rigidity to the sleeve. The user opens nozzle 511 and blows air into to increase the padding. The user opens nozzle 511 and let's air escape to decrease the padding. As illustrated the inflatable regions are interconnected, alternatively the regions 505 are isolated each having a nozzle thereby allowing customization of padding across the entire arm pillow.

The potential exists for varying the production of Arm and Hand Pillow Sleeve in ways which could make it more appealing to a wider range of end users. This could include producing it in small, medium, large, and extra-large sizes. The materials used to produce the Arm and Hand Pillow Sleeve could also vary.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is, therefore, evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

What is claimed is:

1. A pillow sleeve comprising:

a sleeve comprising at least a fabric layer and a memory foam layer configured to wrap entirely around the arm of a user and extend from the user's hand to the user's shoulder for providing a padded surface for sleeping;

a fingerless glove attached to the sleeve and comprising an under wrist pad provided on a top portion of the fingerless glove and a palm wrist pad located on a bottom portion of the fingerless glove;

a flap connected to the sleeve and configured to extend substantially an entire longitudinal length of the sleeve, the flap configured to allow the user to adjust a tightness of the sleeve by adjusting a connection between a section of hook tape provided adjacent a longitudinal peripheral edge of the flap and a section of loop tape provided on an exterior surface of the sleeve; and an elbow pad provided on one of the sleeve or the flap.

* * * * *